US011253855B2

(12) United States Patent
Zhang

(10) Patent No.: US 11,253,855 B2
(45) Date of Patent: Feb. 22, 2022

(54) ARRANGEMENT IN A CAPILLARY DRIVEN MICROFLUIDIC SYSTEM FOR DISSOLVING A REAGENT IN A FLUID

(71) Applicant: miDiagnostics NV, Leuven (BE)

(72) Inventor: Lei Zhang, Leuven (BE)

(73) Assignee: miDiagnostics NV, Leuven (BE)

( * ) Notice: Subject to any disclaimer, the term of this patent is extended or adjusted under 35 U.S.C. 154(b) by 227 days.

(21) Appl. No.: 16/626,998

(22) PCT Filed: Jul. 3, 2018

(86) PCT No.: PCT/EP2018/067951
§ 371 (c)(1),
(2) Date: Dec. 27, 2019

(87) PCT Pub. No.: WO2019/007958
PCT Pub. Date: Jan. 10, 2019

(65) Prior Publication Data

US 2020/0139367 A1 May 7, 2020

(30) Foreign Application Priority Data

Jul. 5, 2017 (EP) ..... 17179778

(51) Int. Cl.
*B01L 3/00* (2006.01)

(52) U.S. Cl.
CPC ..... *B01L 3/502738* (2013.01); *B01L 3/50273* (2013.01); *B01L 3/523* (2013.01);
(Continued)

(58) Field of Classification Search
CPC ..... B01L 2200/16; B01L 2400/0406; B01L 2400/0688; B01L 3/50273; B01L 3/502738; B01L 3/523; B01L 3/527
See application file for complete search history.

(56) References Cited

U.S. PATENT DOCUMENTS

2004/0096358 A1* 5/2004 Blankenstein ..... B01L 3/50273 422/520
2010/0044918 A1 2/2010 Lee et al.
(Continued)

FOREIGN PATENT DOCUMENTS

EP 1525916 A1 4/2005

*Primary Examiner* — Jennifer Wecker
*Assistant Examiner* — Jonathan Bortoli
(74) *Attorney, Agent, or Firm* — Hodgson Russ LLP

(57) ABSTRACT

There is provided an arrangement in a capillary driven microfluidic system for dissolving a reagent in a fluid. The arrangement (200) comprises a channel (102) for receiving a fluid at a first end, a valve (105) arranged at a second end of the channel so as to control a flow of the fluid to stop as it reaches the second end of the channel, and an actuator (108) for opening the valve (105) a predetermined time after receipt of the fluid by the channel (102). The arrangement further comprises one or more structures (106) for holding a dried reagent. The one or more structures (106) each has a width (W2) which is larger than a width (W1) of the channel (102), and the one or more structures are coupled to a side wall of the channel such that the fluid is allowed to enter the one or more structures from the channel, dissolve the dried reagent held therein, and diffuse back into the channel.

14 Claims, 3 Drawing Sheets

Figure 1:
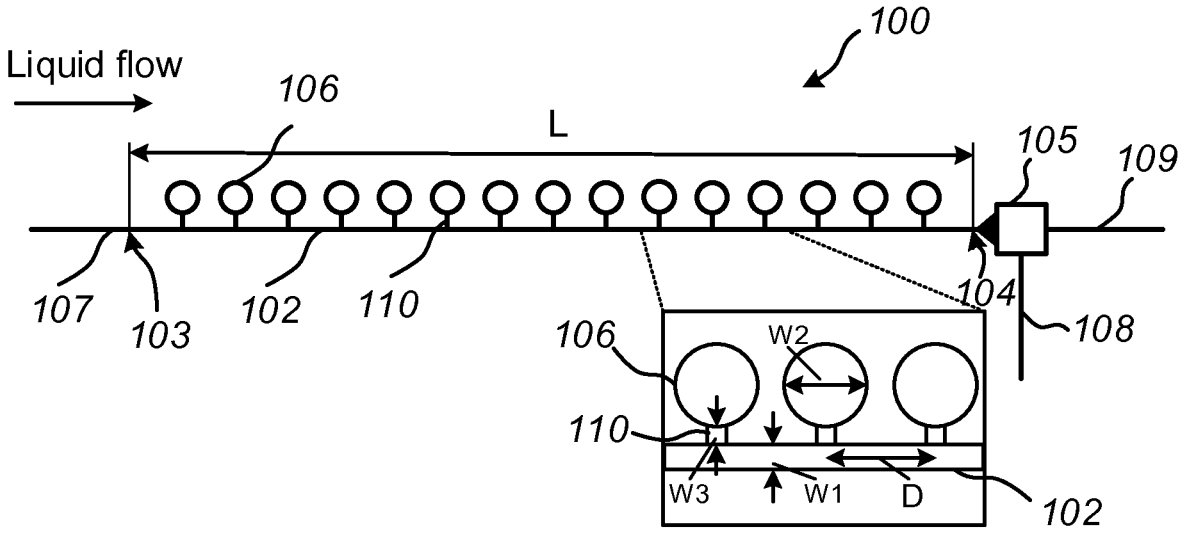

(52) U.S. Cl.
CPC ..... *B01L 3/527* (2013.01); *B01L 2200/16* (2013.01); *B01L 2400/0406* (2013.01); *B01L 2400/0688* (2013.01)

(56) References Cited

U.S. PATENT DOCUMENTS

| | | | |
|---|---|---|---|
| 2010/0323382 | A1 | 12/2010 | Takama |
| 2013/0171640 | A1 | 7/2013 | Kwon et al. |

* cited by examiner

ARRANGEMENT IN A CAPILLARY DRIVEN MICROFLUIDIC SYSTEM FOR DISSOLVING A REAGENT IN A FLUID

TECHNICAL FIELD

The present disclosure relates to capillary driven microfluidic systems. In particular, it relates to an arrangement in a capillary driven microfluidic system for dissolving a reagent in a fluid.

BACKGROUND

The integration of reagents into microfluidic devices is critical for applications in diagnostics and life sciences. One approach of integrating reagents on a chip of a microfluidic device, which allows for a long shelf time of the device, is to store dried reagents on chip and dissolve them by buffer or sample fluids when performing a test. In such an approach, the challenge is to achieve precise conditions, such as volume and concentrations, in reagent dissolution. Considering the low Reynolds number flow condition, which is the case in the scale of microfluidic devices, dissolution of reagents on microfluidic devices can be extremely fast and can cause an accumulation of reagents at the front of the filling liquid, thereby resulting in a non-homogeneous dissolution. To obtain a homogeneous dissolution, reagents have to be distributed better in a certain volume. The reagent distribution can be helped by active fluidics elements, such as a mixer, but these fluidics elements are difficult to fabricate and implement. In a simpler fluidic structure, the distribution can also rely purely on molecule diffusion. However, as reagents used in bio-reactions are often relatively large molecules (100 kDa), molecule diffusion can take more than 10 minutes even in a small length scale (~500 μm), which is not desirable as fast sample-in-to-answer-out time is desired in such devices.

SUMMARY

In order to achieve a homogeneous dissolution of a reagent in a fluid, an arrangement in a capillary driven microfluidic system is provided. The arrangement comprises a channel for receiving a fluid at a first end, a valve arranged at a second end of the channel so as to control a flow of the fluid to stop as it reaches the second end of the channel, one or more structures for holding a dried reagent, and an actuator for opening the valve a predetermined time after receipt of the fluid by the channel. The one or more structures each has a width which is larger than a width of the channel, and the one or more structures are fluidly coupled to the channel such that the fluid is allowed to enter the one or more structures from the channel, dissolve the dried reagent held therein, and diffuse back into the channel.

BRIEF DESCRIPTIONS OF THE DRAWINGS

The above, as well as additional objects, features and advantages, will be better understood through the following illustrative and non-limiting detailed description of embodiments described herein, with reference to the appended drawings, where the same reference numerals will be used for similar elements, wherein:

FIG. 1 schematically illustrates a top view of an arrangement in a capillary driven microfluidic system for dissolving a reagent in a fluid according to embodiments.

Figure 2:
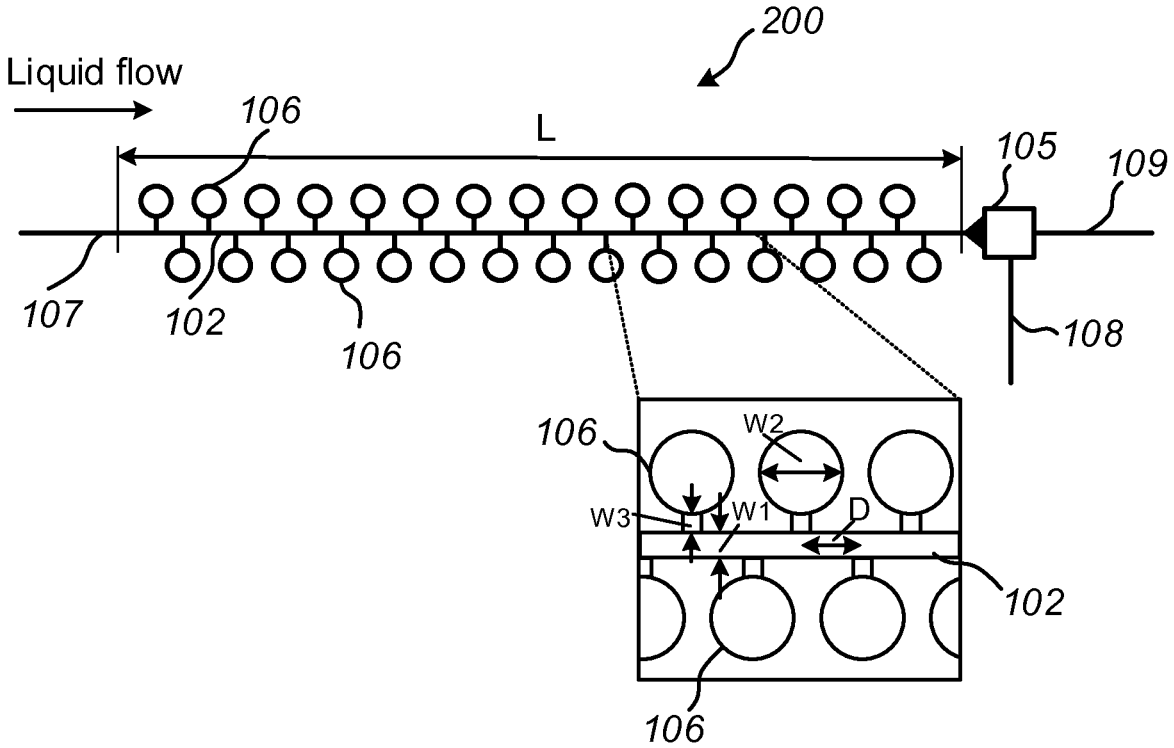

FIG. 2 schematically illustrates a top view of an arrangement in a capillary driven microfluidic system for dissolving a reagent in a fluid according to further embodiments.

Figure 3:
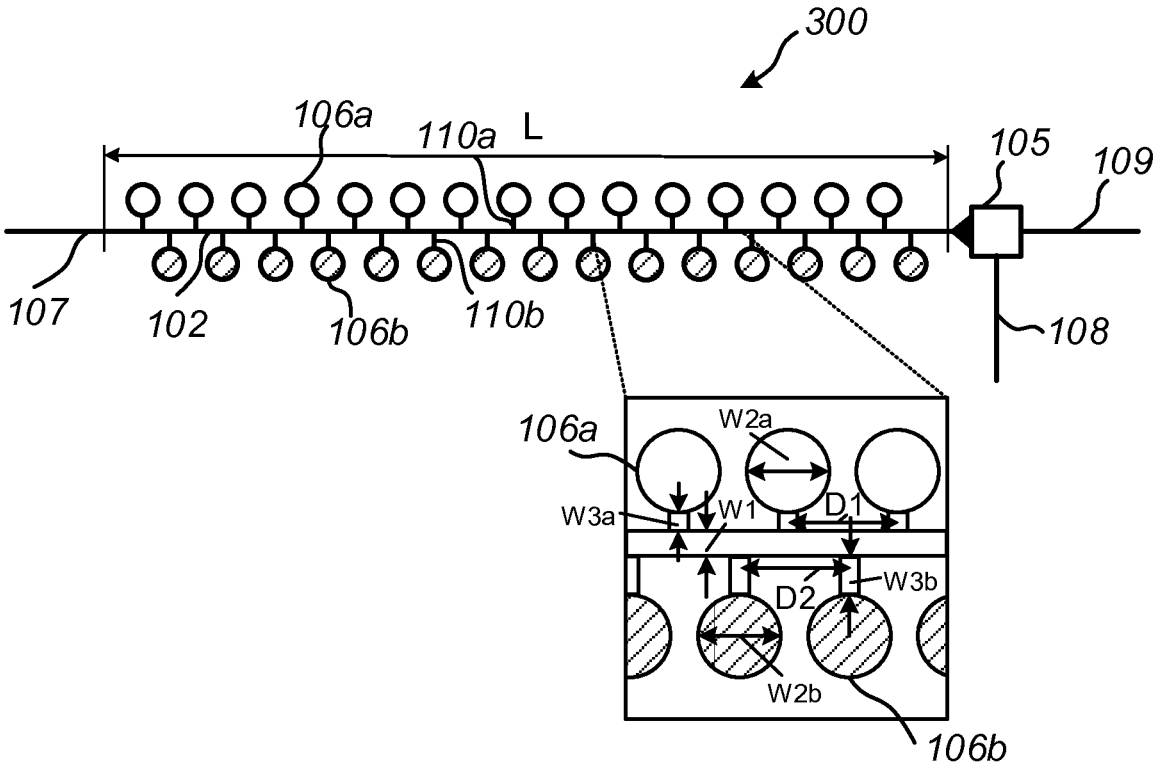

FIG. 3 schematically illustrates a top view of an arrangement in a capillary driven microfluidic system for dissolving two different types of reagents in a fluid according to embodiments.

Figure 4:
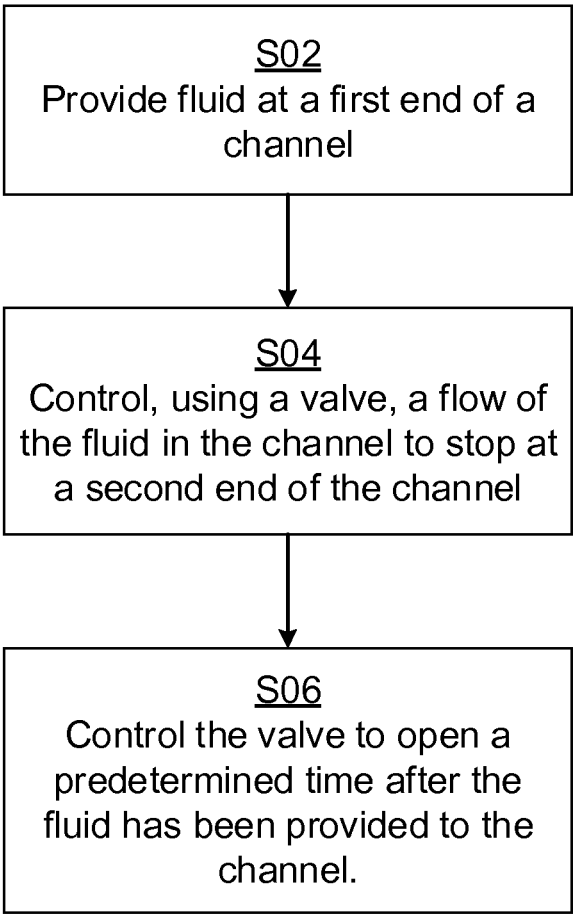

FIG. 4 is a flow chart of a method in a capillary driven microfluidic system for dissolving a reagent in a fluid according to embodiments.

DETAILED DESCRIPTION

It is an object to, at least partly, solve the above mentioned problems of the prior art. In particular, it is an object to achieve a homogeneous dissolution of dried reagents in a fluid in capillary driven microfluidic system.

According to a first aspect, the above object is achieved by an arrangement in a capillary driven microfluidic system for dissolving a reagent in a fluid, comprising:

a channel for receiving a fluid at a first end, a valve arranged at a second end of the channel so as to control a flow of the fluid to stop as it reaches the second end of the channel, one or more structures for holding a dried reagent, the one or more structures each having a width which is larger than a width of the channel, and the one or more structures being fluidly coupled to the channel such that the fluid is allowed to enter the one or more structures from the channel, dissolve the dried reagent held therein, and diffuse back into the channel, and an actuator for opening the valve a predetermined time after receipt of the fluid by the channel.

When in use the above arrangement works as follows. A fluid, such as a buffer fluid or sample fluid, is added upstream of the arrangement in the microfluidic system. Capillary forces draw fluid into the channel. Since the width of the channel is smaller than the width of the structures, the capillary pressure generated by the channel is larger than that of the structures. As a result, the fluid fills up the channel faster than filling up the structures. In this way, accumulation of reagents at the front of the filling liquid is avoided. The fluid flow is then stopped by the valve. In each structure, once it has been filled with fluid, reagent is dissolved and diffuses back into the channel. When homogeneous dissolution is reached in the channel, the valve is actuated and the fluid flows out through the valve, thereby transporting the dissolved reagent for further processing and/or analysis.

As used herein, by width of a channel or structure is generally a dimension of the channel or structure. In particular, by width is meant the largest dimension of the channel or structure that the air-liquid interface of the fluid will encounter when flowing into and through the channel or structure.

The channel, the valve, and the one or more structures may be formed on a surface of a chip, such as a semiconductor chip, a plastic chip, or a hybrid of a semiconductor and plastic chip in which the microfluidic system is formed, e.g., by using etching techniques. The one or more structures may, for instance, each be a recess on the surface of said chip.

The one or more structures may generally have any shape which is suitable for the purpose of holding a dried reagent. The three-dimensional shape of the one or more structures may for instance be spherical, half-spherical, ellipsoidal, half-ellipsoidal, or cylindrical. When etching techniques are used for the fabrication, the one of more structures may typically have a cylindrical shape. In embodiments, the one or more structures may thus each have a circular cross-section, wherein the diameter of the circular cross-section is larger than a width of the channel. The circular shape is advantageous in that it is easy to fabricate. Further, the circular shape may be beneficial when a reagent is spotted in the one or more structures. A droplet of reagent typically has a sphere surface. To have the droplets safely land inside the one or more structures, without having to exaggerate the volume of the structures (which would result in an unnecessarily high reagent consumption), it is advantageous to have a circular shape which matches that of the droplets.

The one or more structures may comprise a plurality of structures being arranged along the channel. For example, the plurality of structures may be arranged in an array-like pattern along the channel. By having a plurality of structures and arranging them along the channel, the homogeneity of the dissolution is further improved since mixing of the fluid with the reagent is provided for along the length of the channel.

The plurality of structures may further be equidistantly arranged along a length of the channel. By arranging the plurality of structures equidistantly along the entire length of the channel, the required time to reach a homogeneous dissolution in the channel can be made independent of the length of the channel. This is because the distance that the molecules in the reagent have to diffuse before reaching a homogeneous dissolution is limited by the distance between the one or more structures rather than the length of the channel. This is advantageous in that the length of the channel can be designed based on volume requirement of reactions and it does not interfere with dissolution time. This is also advantageous in that relatively large volume of reagents can be provided to the fluid without adding reagent distribution time. On the contrary, dissolution time will rather only depend on the width of the channel, the width of the structures, the length of the connection between the channel and the structure, and the distance between neighboring structures. It is to be noted that if the one or more structures are arranged at unequal distances along the channel, the longest distance between two structures will be decisive of the resulting dissolution time.

Larger molecules typically diffuse more slowly than smaller molecules. The dissolution time is thereby affected by the molecule size. For reagents comprising larger molecules it is therefore advantageous to include a higher number of structures than for smaller molecules. In this way, the structures that hold the reagent will be arranged closer to each other such that the diffusion length, i.e., the distance that the molecules need to diffuse, is decreased. A number of the plurality of structures and the distance between the plurality of structures may thus depend on a size of molecules in the dried reagent. For larger molecules, a higher number of structures and, thereby, a smaller distance is typically selected than for smaller molecules.

Some applications require that different dried reagents, i.e., dried reagents of different types, are physically separated in storage. In such cases, the arrangement may comprise a first plurality of structures for holding a first type of reagent, and a second plurality of structures for holding a second type of reagent. In this way, the arrangement may provide a solution for spotting different reagents in different structures with a limited additional dissolution time. It is to be understood that this generalizes to more than two different types of reagents, i.e., there may be a third plurality of structures for holding a third type of reagent etc.

Further, the distance between the first plurality of structures and the distance between the second plurality of structure may be designed depending on the molecule sizes of the dried reagents of the first and the second type. For example, the structures of the first plurality of structures may be arranged at a first distance from each other, and the structures of the second plurality of structures may be arranged at a second, different, distance from each other.

Each of the one or more structures may be fluidly coupled to the channel via a passage. The length of the passage will also affect the diffusion time and may also hence be seen as a design parameter. In more detail, the arrangement may comprise a first plurality of structures for holding a first type of reagent, and a second plurality of structures for holding a second type of reagent, wherein each structure of the first plurality of structures is fluidly coupled to the channel via a first passage having a first length, and wherein each structure of the second plurality of structures is fluidly coupled to a the channel via a second passage having a second length which is different from the first length. In this way, the passages may be designed to have different lengths depending on the type of reagent and molecule size of the reagent. Generally, a shorter passage may be used for larger molecules than for smaller molecules.

The one or more structures may be fluidly coupled to a side wall of the channel. The one or more structures may be arranged along both side walls of the channel. The positions along the channel of structures arranged along a first side wall may further be shifted with respect to positions along the channel of structures arranged along a second side wall. In this way, the diffusion length, i.e., the length that reagents need to diffuse, may be further reduced, thereby further reducing the total dissolution time.

In cases where different reagent types are used, the first plurality of structures may be arranged along a first side wall of the channel, and the second plurality of structures may be arranged along a second, opposite, side wall of the channel.

The predetermined time (after which the valve is opened) may correspond to a time for reaching a homogeneous dissolution of the reagent in the channel. In particular, the predetermined time may be equal to or greater than a time for reaching a homogeneous dissolution of the reagent in the channel. The time for reaching a homogeneous dissolution of the reagent in the channel may be calculated based on the design parameters of the arrangement. This time may thus be calculated in advance and is hence a predetermined time. In particular, the predetermined time may depend on a molecule size of the dried reagent and a distance between the one or more structures. The time for reaching a homogeneous dissolution of a reagent may also depend on the width of the channel, the width of the structures, and the length of the passage between the channel and the structure. Notably, however, the time for reaching a homogeneous dissolution is, at least for some embodiments described herein, independent of the length of the channel. For the purpose of calculating the time for reaching a homogeneous dissolution, the arrangement may optionally comprise a processor or other processing device which, based on input of the design parameters of the arrangement, calculates the predetermined time, i.e., the time between fluid intake and valve opening. The processor or processing device may further be associated with the actuator so as to control the actuator to open the valve after the predetermined time.

The valve may be a (passive) capillary trigger valve. Capillary trigger valves are easy to fabricate, implying a low fabrication cost, and have a reliable performance. Alternatively, the valve may be an electrically triggered valve, and the actuator may be in the form of an electrical actuator which causes the valve to open upon receipt of an electrical control signal from the actuator.

According to a second aspect, there is provided a diagnostic device comprising the arrangement of the first aspect.

According to a third aspect, there is provided a method in a capillary driven microfluidic system for dissolving a reagent in a fluid, comprising:

providing a fluid at a first end of a channel, whereby the fluid is drawn into the channel by capillary forces, controlling, by means of a valve arranged at a second end of the channel, a flow of the fluid in the channel to stop as it reaches the second end of the channel, wherein one or more structures holding a dried reagent are fluidly coupled to the channel, the one or more structures each having a width which is larger than a width of the channel, whereby, as fluid is drawn into the channel, the fluid enters the one or more structures from the channel, dissolves the dried reagent held therein, and diffuses back into the channel, controlling, by means of an actuator, the valve to open a predetermined time after the fluid has been provided to the channel, whereby the fluid with the reagent dissolved therein flows out of the channel.

The second and third aspects may generally have the same features and advantages as the first aspect. It is further noted that the inventive concepts relate to all possible combinations of features unless explicitly stated otherwise.

Exemplary embodiments will now be described more fully hereinafter with reference to the accompanying drawings. The inventive concepts may, however, be embodied in many different forms and should not be construed as limited to the embodiments set forth herein; rather, these embodiments are provided for thoroughness and completeness, and fully convey the scope of the inventive concepts to the skilled person.

FIG. 1 schematically illustrates an arrangement 100 which is part of a capillary driven microfluidic system. The arrangement 100 may, for example, be implemented on a semiconductor chip or in a cartridge of a diagnostic device, such as a lab-on-chip diagnostic device. The channels, valves, structures etc. may be formed in a surface of the chip by using etching techniques as known in the art.

The arrangement 100 comprises a channel 102. The channel 102 is arranged to receive a liquid fluid at a first end 103 from the microfluidic system upstream of the arrangement 100, e.g., via a channel 107. The fluid is drawn into the channel 107 by capillary forces. A valve 105 is arranged at a second end 104 of the channel 102. The valve 105 is initially in a closed configuration. As a fluid flow in the channel 102 reaches the valve 105, the fluid flow is therefore stopped. The arrangement 100 further comprises an actuator 108 for opening the valve 105, i.e., changing the configuration of the valve 105 from a closed to an open configuration. The actuator 108 may be arranged to open the valve 105 after a predetermined amount of time after receipt of the fluid by the channel 102, such that fluid in the channel 102 may flow out through the valve 105 to the part of the microfluidic system being arranged downstream of the arrangement 100, here represented by channel 109. In the context of this application, the predetermined time corresponds to a time for reaching a homogeneous dissolution of a reagent in the channel 102 as further explained below. By way of example, the valve 105 may be a passive capillary trigger valve. In such case, the actuator 108 may be in the form of a trigger channel 108 which actuates the valve 105 as a fluid in the trigger channel 108 reaches the valve 105. Alternatively, the valve 105 may be an electrically triggered valve, and the actuator 108 may be in the form of an electrical actuator which causes the valve 105 to open upon receipt of an electrical control signal from the actuator 108.

The arrangement further comprises one or more structures 106 for holding a dried reagent. The structures 106 may hence be seen as a holder or receptacle for a dried reagent. Reagents of interest are typically spotted and dried in each of the one or more structures 106 in advance.

The one or more structures 106 may be in the form of a recess in a surface of a chip in which the arrangement is implemented. As shown in the example of FIG. 1, the one or more structures 106 may have a circular shape, although other shapes are also possible.

The one or more structures 106 are fluidly coupled to a side wall of the channel 102. In more detail, each the one or more structures 106 may be coupled to a side wall of the channel 102 via a passage 110. In this way, fluid is allowed to enter the one or more structures 106 from the channel 102, via the passage 110. Fluid may in this way be drawn into the one or more structures 106.

As shown in the blown-up part of FIG. 1, the width W2 of the structures 106 is larger than the width W1 of the channel. The heights of the channel and the structures are the same. Since the widths W1 and W2 are directly related to the capillary pressure in the channel 102 and the one or more structures 106, this implies that the capillary pressure generated by the channel 102 is larger than the capillary pressure generated by the one or more structures 106. As a result, the fluid fills up the channel 102 faster than the structures 106. In case of structures 106 having a circular cross-section, the width W2 corresponds to the diameter of the circular shape. However, by width of a channel or structure as used herein is generally meant the largest dimension of the channel or structure that the air-liquid interface of the fluid will encounter when flowing into and through the channel or structure.

As fluid enters the structures 106 it will dissolve the reagent held therein, and then diffuse back into the channel 102. The reagent in the structures 106 is in this way picked-up by the fluid, and the structures 106 may therefore be referred to as pick-up structures (or pick-up circles in case of a circular shape). Thus, as the fluid has dissolved the reagent, molecules in the reagent starts to diffuse into the channel 102. Since the structures 106 are filled up more slowly than the channel 102, accumulation of reagents at the front of the filling liquid is avoided. In the beginning of the diffusion process, the concentration of molecules will be non-homogeneous in the channel 102. However, after a while, the concentration of molecules will be homogeneous in the channel 102, and at that time the actuator 108 may open the valve 105 to let the fluid out of the channel 102.

In principle it is enough to have one structure 106. However, the dissolution time, i.e., the time until a homogeneous concentration of molecules in the channel 102 is reached, may decrease significantly if there is a plurality of structures 106 since the dissolution time is directly related to the distance that the molecules have to diffuse. As shown in FIG. 1, a plurality of structures 106 may therefore be arranged along the length L of the channel 102. The plurality of structures 106 may be arranged equidistantly, e.g., at distance D from each other. This puts a limit on how far the molecules need to diffuse before a homogeneous concentration is reached. Further, larger molecules typically diffuse more slowly than smaller molecules. Therefore, the distance D may be designed depending on the molecule size, such that a smaller D is selected for larger molecules than for smaller molecules. The length W3 of the passage 110 will also affect the dissolution time. A longer length W3 of the passage 110 will result in a longer dissolution time since the molecules in the reagent have to diffuse a longer distance.

In view of the above, the widths W1, W2, the length W3, and the distance D are design parameters of the arrangement 100. Once these have been set, the dissolution time, i.e., the time for reaching a homogeneous dissolution in the channel 102 may be calculated for the reagent at hand. The so calculated dissolution time may be used to determine when to actuate the valve 105 to open, i.e., the valve 105 should be opened when or after a homogeneous dissolution in the channel has been achieved.

In one experiment, the one or more structures 106 of the embodiment of FIG. 1 had a cylindrical shape of diameter 100 μm, and the width of the channel 102 was 30 μm. An antibody of molecule weight 50 kDa was used as a reagent. Under those circumstances, it took about 1 min until a homogeneous solution was achieved in the channel 102.

In the embodiment of FIG. 1, the one or more structures 106 are arranged along one side wall of the channel 102. FIG. 2 illustrates an arrangement 200 where the structures 106 instead are arranged along both side walls of the channel 102. The positions of the structures 106 along one of the side walls or the channel 102 may be shifted in relation to the positions of the structures 106 along the other side wall of the channel 102. For example, the positions along one side wall may be shifted by half the distance between the positions along the other side wall. By making use of both side walls, the arrangement can fit more structures 106 along the channel 102, and by shifting the positions along the channel, the distance D between the structures along the channel may be reduced. For instance, the distance D in the FIG. 2 embodiment is halved compared to the FIG. 1 embodiment. Thereby the dissolution time may be reduced further.

In one experiment, the one or more structures 106 of the embodiment of FIG. 2 had a cylindrical shape of diameter 100 μm, and the width of the channel 102 was 30 μm. An antibody of molecule weight 150 kDa was used as a reagent. Under those circumstances, it took about 3.5 min until a homogeneous solution was achieved in the channel 102.

FIG. 3 illustrates an arrangement 300 for dissolving two different types of dried reagents which need to be separately stored. The arrangement 300 differs from the arrangements 100 and 200 in that it comprises a first plurality of structures 106*a* for holding a first type of reagent, and a second plurality of structures 106*b* for holding a second type of reagent. Similar to the arrangement 200 of FIG. 2, the structures are arranged along both side walls of the channel 102. In particular, the first plurality of structures 106*a* is arranged along a first side wall of the channel 102, and the second plurality of structures 106*b* is arranged along a second side wall of the channel 102. The structures of the first plurality of structures 106*a* are arranged at a first distance D1 from each other, and the structures of the second plurality of structures 106*b* are arranged at a second distance D2 from each other. The first distance D1 and the second distance D2 may be different. For instance, the first distance D1 may be designed on basis of the molecule size of the first reagent, and the second distance D2 may be designed on basis of the molecule size of the second reagent. The distances D1 and D2 may be designed such that the time for reaching a homogeneous concentration of the first reagent in the channel 102 is the same or about the same as the time for reaching a homogeneous concentration of the second reagent in the channel 102.

Further, the length W3*a* of the passages 110*a* of the first plurality of structures may be designed to be different than the length W3*b* of the passages 110*b* of the second plurality of structures. For example, the lengths $W3_1$ and $W3_2$ may be designed on basis of the molecule size of the first and the second reagent to compensate for the fact that larger molecules diffuse slower than smaller molecules.

Further, the width W2*a* of the first plurality of structures 106*a* and the width W2*b* of the second plurality of structures 106*b* may be designed to be different. Also in this case, the widths W2*a* and $W2_b$ may be designed on basis of molecule size of the different reagents.

In view of the above, the distances D1 and D2, the widths W2*a*, W2*b* of the structures 106*a*, 106*b*, and the lengths W3*a*, W3*b* of the passages 110 are all design parameters which, in addition to the width W1 of the channel, affect the final dissolution time. For example, the distances D1 and D2, and/or the widths W2*a*, W2*b* of the structures 106*a*, 106*b*, and/or the lengths W3*a*, W3*b* of the passages 110 may be designed such that the time for reaching a homogeneous concentration of the first reagent in the channel 102 is the same or about the same as the time for reaching a homogeneous concentration of the second reagent in the channel 102.

The use of the arrangements 100, 200, 300 will now be described with reference to the flow chart of FIG. 4.

In step S02, a fluid is provided at a first end of the channel 102. Since the channel 102 is a capillary channel, i.e., a channel of capillary dimensions, this causes the fluid to be drawn into the channel 102 by capillary forces. The fluid may, e.g., be a biological fluid such as blood or urine.

In step S04, a flow of the fluid in the channel is controlled to stop as it reaches the second end 104 of the channel. This may be achieved by arranging the valve 105 in a closed configuration. If a passive valve 105, such as a capillary trigger valve, is used, it will be in a closed configuration as long as it is dry, i.e., as long as no fluid has reached the valve 105 in the trigger channel 108. This would normally be the initial configuration of such a valve 105. If another valve technology is used, such as an electrically controlled valve, the valve 105 may actively have to be set to a closed configuration, e.g., by sending an appropriate control signal to the valve 105.

As fluid is drawn into the channel 102, it will enter the one or more structures 106, 106*a*, 106*b*, i.e., it will further be drawn into the structures 106, 106*a*, 106*b* by means of capillary forces. However, since the width W2, W2*a*, W2*b* of the structures 106, 106*a*, 106*b* is larger than the width W1 of the channel 102, the structures 106, 106*a*, 106*b* will fill up more slowly than the channel 102 as explain above. When fluid enters the one or more structures 106, 106*a*, 106*b* it will dissolve the dried reagent held in the structures 106, 106*a*, 106*b*. Thus, molecules of the dried reagent will be dissolved in the fluid in the structures 106, 106*a*, 106*b*. The molecules will then start to diffuse back into the channel 102. As explained above, the speed at which the molecules diffuse into the channel 102 will depend on the size of the molecules. Initially, the concentration of the molecules, i.e., the reagent, in the channel 102 will be non-uniform and the concentration will be higher at positions where the one or more structures 106, 106*a*, 106*b* mouth into the channel 102. Typically, the concentration of reagent at each a position where a structure 106, 106*a*, 106*b* mouths into the channel 102 follows a Gaussian distribution which peaks at the position where the structure 106, 106*a*, 106*b* mouths into the channel 102. However, as time passes by and the molecules diffuse further away, the standard deviation of that Gaussian distribution will become larger and also the overlap with respect to the corresponding Gaussian distributions of neighboring structures 105, 106*a*, 106*b* will become more significant. Thus, after some predetermined amount of time, the concentration of the reagent in the channel 102 will be uniform, or at least essentially uniform.

After that predetermined amount of time has lapsed, i.e., when a uniform or at least essentially uniform concentration of the reagent has been achieved in the channel 102, the valve 105 is controlled to open by means of the actuator 108. In case of a passive valve 105, such as a capillary trigger valve, this may be achieved by passing a fluid in a trigger channel of the valve 105 so as to wet the valve, thereby causing the fluid held in the channel 102 to flow out through the valve 105. If other valve technology is used, such as an electrically controlled valve, this may instead be achieved by sending an appropriate control signal to the valve 105 to open.

The embodiments herein are not limited to the above described examples. Various alternatives, modifications and equivalents may be used. Therefore, this disclosure should not be limited to the specific form set forth herein. This disclosure is limited only by the appended claims and other embodiments than the mentioned above are equally possible within the scope of the claims.

The invention claimed is:

1. A capillary driven microfluidic system comprising an arrangement for dissolving a reagent in a fluid, the arrangement comprising:

a channel for receiving a fluid at a first end, a valve arranged at a second end of the channel and configured to control a flow of the fluid to stop as it reaches the second end of the channel, one or more structures for holding a dried reagent, the one or more structures each having a width (W2) which is larger than a width (W1) of the channel, wherein the one or more structures are fluidly coupled to a side wall of the channel via a passage such that the fluid is allowed to enter the one or more structures from the channel via the passage, dissolve the dried reagent held therein, and diffuse back into the channel via the passage, and an actuator configured to open the valve a predetermined time after receipt of the fluid by the channel.

2. The arrangement of claim 1, wherein the channel, the valve, and the one or more structures are formed on a surface of a chip, and wherein the one or more structures each is a recess on the surface of said chip.

3. The arrangement of claim 1, wherein the one or more structures each has a circular cross-section, wherein the diameter (W2) of the circular cross-section is larger than a width (W1) of the channel.

4. The arrangement of claim 1, wherein the one or more structures comprise a plurality of structures being arranged along the channel.

5. The arrangement of claim 4, wherein the plurality of structures are equidistantly arranged along a length (L) of the channel.

6. The arrangement of claim 5, wherein a number of the plurality of structures and a distance (D) between the plurality of structures depend on a size of molecules in the dried reagent.

7. The arrangement of claim 1, wherein the one or more structures comprises:

a first plurality of structures for holding a first type of reagent, a second plurality of structures for holding a second type of reagent, wherein the structures of the first plurality of structures are arranged at a first distance (D1) from each other, and the structures of the second plurality of structures are arranged at a second, different, distance (D2) from each other.

8. The arrangement of claim 1, wherein the one or more structures comprises:

a first plurality of structures for holding a first type of reagent, a second plurality of structures for holding a second type of reagent, wherein each structure of the first plurality of structures is fluidly coupled to the channel via a first passage having a first length (W3*a*), and wherein each structure of the second plurality of structures is coupled to the channel via a second passage having a second length (W3*b*) which is different from the first length (W3*a*).

9. The arrangement of claim 7, wherein the first plurality of structures is arranged along a first side wall of the channel, and the second plurality of structures is arranged along a second, opposite, side wall of the channel.

10. The arrangement of claim 1, wherein the predetermined time is equal to or greater than a time for reaching a homogeneous dissolution of the reagent in the channel.

11. The arrangement of claim 1, wherein the predetermined time depends on a molecule size of the dried reagent and a distance (D) between the one or more structures.

12. The arrangement of claim 1, wherein the valve is a capillary trigger valve.

13. A diagnostic device comprising the arrangement of claim 1.

14. A method in a capillary driven microfluidic system for dissolving a reagent in a fluid, comprising:

providing a fluid at a first end of a channel, whereby the fluid is drawn into the channel by capillary forces, controlling, by means of a valve arranged at a second end of the channel, a flow of the fluid in the channel to stop as it reaches the second end of the channel, wherein one or more structures holding a dried reagent, each are fluidly coupled to a side wall of the channel via a passage, the one or more structures each having a width (W2) which is larger than a width (W1) of the channel, whereby, as fluid is drawn into the channel, the fluid enters the one or more structures from the channel via a passage, dissolves the dried reagent held therein, and diffuses back into the channel via a passage, controlling, by means of an actuator, the valve to open a predetermined time after the fluid has been provided to the channel, whereby the fluid with the reagent dissolved therein flows out of the channel.

* * * * *